US011511915B2

(12) United States Patent
Lipshy et al.

(10) Patent No.: US 11,511,915 B2
(45) Date of Patent: Nov. 29, 2022

(54) CHILD RESISTANT CONTAINER HAVING AN AUDIO DEVICE

(71) Applicants: Brian Louis Lipshy, Delray Beach, FL (US); Robert S. Saraga, Delray Beach, FL (US)

(72) Inventors: Brian Louis Lipshy, Delray Beach, FL (US); Robert S. Saraga, Delray Beach, FL (US)

( * ) Notice: Subject to any disclaimer, the term of this patent is extended or adjusted under 35 U.S.C. 154(b) by 82 days.

(21) Appl. No.: 16/865,305

(22) Filed: May 2, 2020

(65) Prior Publication Data

US 2021/0107705 A1 Apr. 15, 2021

Related U.S. Application Data

(60) Provisional application No. 62/841,339, filed on May 1, 2019.

(51) Int. Cl.

| | |
|---|---|
| ***B65D 41/06*** | (2006.01) |
| ***B65D 51/24*** | (2006.01) |
| ***A61J 7/04*** | (2006.01) |
| ***A61J 1/03*** | (2006.01) |
| ***A61J 1/00*** | (2006.01) |

(Continued)

(52) U.S. Cl.

CPC ..... *B65D 41/06* (2013.01); *B65D 51/248* (2013.01); *A61J 1/03* (2013.01); *A61J 7/04* (2013.01); *A61J 7/0436* (2015.05); *B65D 55/028* (2013.01); *B65D 2203/12* (2013.01); *B65D 2215/02* (2013.01)

(58) Field of Classification Search

CPC .. B65D 41/06; B65D 51/248; B65D 2203/12; B65D 2215/02; B65D 55/028; A61J 1/03; A61J 2205/70; A61J 7/0481; A61J 7/0418; A61J 7/0436; G08B 13/149

USPC ..... 206/459.1; 340/571, 568.2, 540; 200/300

See application file for complete search history.

(56) References Cited

U.S. PATENT DOCUMENTS 1,456,333 A 5/1923 Nelson
1,514,337 A * 11/1924 Rappenecker ..... B65D 41/06 215/252

(Continued)

FOREIGN PATENT DOCUMENTS

WO 2004065243 A1 8/2004

*Primary Examiner* — Gideon R Weinerth
(74) *Attorney, Agent, or Firm* — Allen F. Bennett; Bennett Intellectual Property

(57) ABSTRACT

A container having a child resistant lock and an audio device has a bottom, an outer wall, and a neck extending upward from its top. The neck has one or more slots formed by a vertical channel and a slanted channel leading to a seat. The slanted channel has two opposing protuberances where it joins the seat. A lid has a cuff configured to fit over the neck. The inside wall of the cuff has one or more pins complementary to the one or more channels which together form bayonet lock mechanisms. And gasket at the inside top of the cuff seals the container when the bayonet lock mechanisms are engaged and provide an upward bias to the cuff, thereby securing it in place. The outer wall of the cuff and outer wall of the canister lie flush with each other when the bayonet lock mechanisms are engaged. The top of the lid has a removable screen covering a compartment in the lid which houses an audio device. A plurality of apertures in the plate allow sound to emit from the music box.

4 Claims, 3 Drawing Sheets

(51) Int. Cl.
*G08B 21/00* (2006.01)
*B65D 55/02* (2006.01)

(56) References Cited

U.S. PATENT DOCUMENTS 2,165,825 A * 7/1939 Von Bultzingslowen ..... B65D 47/242 222/519
3,447,709 A * 6/1969 Marasco ..... B65D 50/067 D9/453
3,497,096 A * 2/1970 Smith ..... B65D 50/061 215/217
3,696,955 A * 10/1972 Kundt ..... B65D 50/041 215/217
3,749,270 A * 7/1973 Affleck ..... B65D 41/06 215/222
3,927,783 A * 12/1975 Bogert ..... B65D 41/06 215/222
4,128,184 A 12/1978 Northup
4,736,857 A * 4/1988 Monico, Jr. ..... B65D 55/028 215/230
4,756,222 A * 7/1988 Armato ..... G10H 1/26 984/341
4,801,929 A * 1/1989 Instance ..... B65D 55/028 340/692
4,845,470 A * 7/1989 Boldt, Jr. ..... B65D 5/4291 340/540
4,847,597 A * 7/1989 Dobosi ..... B65D 51/248 340/571
4,939,705 A * 7/1990 Hamilton ..... A61J 7/0436 368/10
5,038,967 A * 8/1991 Braun ..... B65D 47/42 222/519
5,181,189 A * 1/1993 Hafner ..... A61J 7/0481 206/534
5,217,130 A * 6/1993 Weinstein ..... B65D 50/041 215/208
5,233,571 A * 8/1993 Wirtschafter ..... G04G 15/00 368/10
5,464,092 A * 11/1995 Seeley ..... G10H 1/26 206/217
5,852,590 A * 12/1998 de la Huerga ... G06K 19/07762 368/10
6,158,613 A * 12/2000 Novosel ..... A61J 7/0481 221/3
6,239,712 B1 * 5/2001 Hawk ..... B65D 55/024 206/807
6,259,794 B1 * 7/2001 Dobbins ..... B65D 23/00 215/400
6,271,753 B1 * 8/2001 Shukla ..... B65D 55/028 340/571
6,317,390 B1 * 11/2001 Cardoza ..... A61J 7/0481 221/2
6,324,123 B1 * 11/2001 Durso ..... A61J 7/0481 368/10
6,378,713 B2 4/2002 Montgomery
6,424,599 B1 * 7/2002 Ditzig ..... A61J 7/0436 368/10
6,545,594 B1 * 4/2003 Knight ..... B65D 51/248 206/217
6,633,796 B1 * 10/2003 Pool ..... A61J 7/0481 221/15
6,771,165 B2 * 8/2004 Burg, II ..... B65D 51/248 340/384.1
7,081,807 B2 * 7/2006 Lai ..... G08B 21/24 368/110
7,138,906 B2 * 11/2006 Rosche ..... G08B 3/10 368/244
7,336,194 B2 * 2/2008 Hillman ..... B65D 51/18 340/686.1
7,382,692 B1 * 6/2008 Hildebrandt ..... A61J 7/0472 368/110
7,408,843 B2 * 8/2008 Brandon ..... A61J 7/0472 368/10
7,554,434 B1 * 6/2009 Gifford ..... A61J 7/0436 215/230
7,719,927 B1 * 5/2010 Robinson ..... A61J 7/0481 368/10
8,026,796 B2 * 9/2011 Kiran ..... A61J 7/0472 340/309.16
8,269,613 B2 * 9/2012 Lazar ..... A61J 7/0481 700/240
8,319,613 B2 * 11/2012 Lazar ..... A61J 1/14 700/240
8,446,799 B2 * 5/2013 Burke, Jr. ..... G04F 8/08 368/10
8,896,459 B2 * 11/2014 Denison ..... B65D 51/24 340/691.1
9,597,262 B2 * 3/2017 Morgan ..... A61J 7/0418
9,710,608 B2 * 7/2017 Mikhail ..... B65D 51/248
10,160,566 B2 * 12/2018 McKenzie ..... B65D 1/0246
10,201,479 B2 * 2/2019 Nazginov ..... A61J 1/1418
10,265,247 B1 * 4/2019 Sidi ..... A61J 7/0481
10,358,272 B2 * 7/2019 Brotzel ..... A61J 1/1418
10,675,216 B2 * 6/2020 Mejia ..... A61J 7/04
10,957,436 B1 * 3/2021 Aertker ..... A61J 1/03
2002/0000908 A1 * 1/2002 Burg, II ..... B65D 51/248 340/328
2002/0093427 A1 * 7/2002 Roth ..... G08B 21/24 340/573.1
2002/0126585 A1 * 9/2002 Osberg ..... A61J 7/0472 215/230
2003/0189494 A1 * 10/2003 Lin ..... B65D 51/28 340/568.1
2005/0151625 A1 * 7/2005 Lai ..... G08B 21/24 368/244
2006/0139151 A1 * 6/2006 Rosche ..... A61J 7/0481 368/10
2006/0220818 A1 * 10/2006 Trochesset ..... B65D 51/248 368/10
2006/0255004 A1 11/2006 Shingle et al.
2006/0255032 A1 * 11/2006 Borene ..... G08B 3/10 206/457
2008/0118225 A1 * 5/2008 Wierzoch ..... B65D 51/248 386/358
2009/0200327 A1 * 8/2009 Jurkovich ..... A61J 7/0472 221/3
2009/0294521 A1 * 12/2009 de la Huerga ... G06K 19/07762 235/375
2010/0006585 A1 * 1/2010 Flowers ..... A61J 7/0409 221/7
2010/0142330 A1 * 6/2010 Reygaert ..... A61J 7/0436 368/10
2010/0270257 A1 * 10/2010 Wachman ..... G06Q 10/10 215/228
2011/0227734 A1 * 9/2011 Ortenzi ..... G08B 13/1436 340/568.1
2011/0241849 A1 * 10/2011 Jacobs ..... A61J 7/0481 340/309.7
2013/0220853 A1 * 8/2013 Weldon ..... A63B 47/00 206/315.9
2014/0130453 A1 * 5/2014 Shalala ..... A61J 7/0418 368/10
2014/0266760 A1 * 9/2014 Burke, Jr. ..... G16H 20/13 340/687
2014/0341411 A1 * 11/2014 Mohindra ..... A61J 7/0436 381/334
2015/0332575 A1 * 11/2015 Huntley ..... B65D 41/00 340/687
2015/0360834 A1 * 12/2015 Mikhail ..... B65D 51/248 340/384.5
2016/0048657 A1 * 2/2016 LeBrun ..... A61J 1/1412 705/2
2016/0203686 A1 * 7/2016 Auer ..... F21S 8/00 340/691.1
2016/0212389 A1 * 7/2016 Mehrotra ..... A61J 7/04
2016/0253477 A1 * 9/2016 Xu ..... A61J 1/1412 340/687

(56) References Cited

U.S. PATENT DOCUMENTS

| | | | | |
|---|---|---|---|---|
| 2017/0158389 | A1* | 6/2017 | Lavelock | B65D 51/248 |
| 2017/0316298 | A1* | 11/2017 | Chu | G16H 20/13 |
| 2017/0334631 | A1* | 11/2017 | Veltri | B65D 43/163 |
| 2018/0042817 | A1* | 2/2018 | Wachman | A61J 7/0409 |
| 2018/0228696 | A1* | 8/2018 | Rawal | A61J 7/049 |
| 2018/0263854 | A1* | 9/2018 | Taylor | G08B 21/24 |
| 2020/0146942 | A1* | 5/2020 | Syed | B65D 51/248 |
| 2021/0009303 | A1* | 1/2021 | Kim | B65D 50/00 |
| 2021/0107705 | A1* | 4/2021 | Lipshy | B65D 51/248 |
| 2022/0192927 | A1* | 6/2022 | Sanghavi | A61J 7/0445 |

* cited by examiner

CHILD RESISTANT CONTAINER HAVING AN AUDIO DEVICE

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

COPYRIGHT NOTICE

Not Applicable

BACKGROUND OF THE INVENTION

Field of the Invention

The present invention relates to a childproof container. More particularly, the invention relates to a childproof container with smooth sides and a musical cap.

Description of the Related Art

Children have a well-known tendency to put small objects in their mouths and to swallow them with no awareness of the potentially harmful effects. They also have a fascination for containers of any kind. Tragic results have followed when children follow their natural propensities leading them to ingest materials that are harmful is swallowed in large quantities or are not suitable for children.

Many medicine and other containers have been proposed that are intended to be difficult or impossible for children to open. For the most part, such "child-proof" containers that are in common use today are bottles with caps that are removable by some combination of twisting, pushing and pulling actions. Typically these containers are difficult to open for adults as well as children. Many also do not have smooth surfaces that allow efficient storage.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a musical childproof container.

BRIEF SUMMARY OF THE INVENTION

Disclosed is a container having a child resistant lock and audio feature. The body is defined by an outer wall extending between a base and a top. A cylindrical neck extends upward from the top of the container, and has two or more radially spaced slots. A lid for the container has a top surface defined by a perimeter. A cuff extends downward from the perimeter of the lid and has two or more radially spaced pins protruding inwardly from a cylindrical inner wall of the cuff. The pins are complimentary to the radially spaced slots of the neck. A compartment in the lid extends downward from an opening in the top surface of the lid. A sound emitting device is housed in the compartment. The pins and slots engage to form a bayonet lock mechanism for removably securing the cap to the top of the container. The container may be cylindrical having a circular top. The compartment may also be cylindrical and concentric to the container. A removable protective screen extends over the opening to the compartment.

In one embodiment, the pins include a distal electrical contact pad and the slots are in electrical communication with each other. When the lid is attached to the neck, a closed electrical circuit is formed through the slots.

It is therefore an object of the present invention to provide a childproof container having a musical device housed within its cap.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
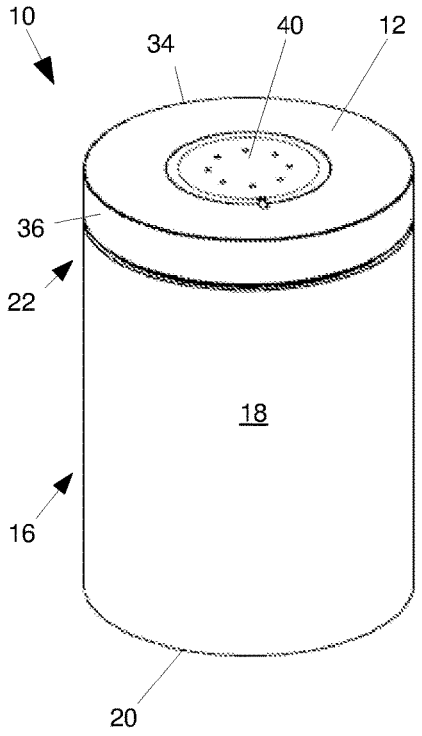
FIG. 1 is a perspective view of a container attached to a lid in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein. Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Figure 2:
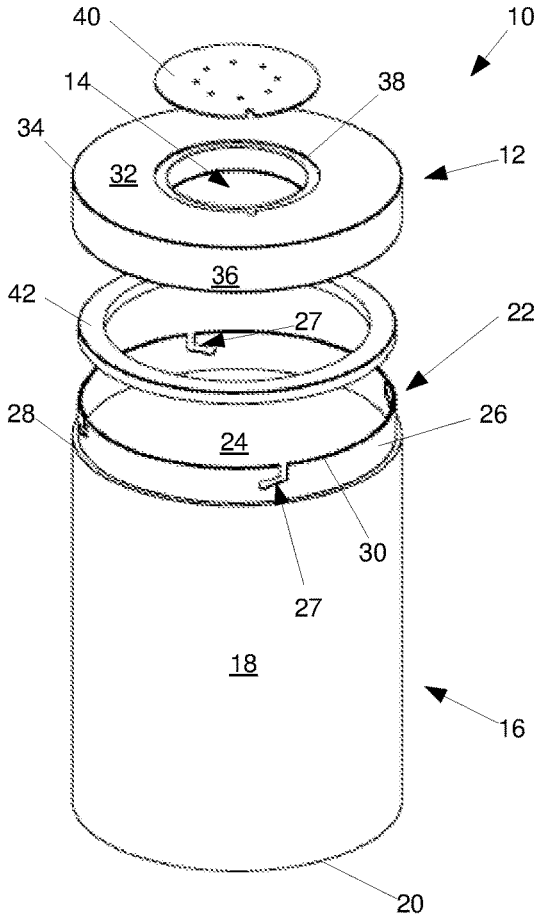
FIG. 2 is an exploded view of a container in accordance with principles of the invention.

Disclosed is a child resistant container having an audio feature. FIGS. 1-5 show an exemplary embodiment of a container in accordance with the principles of the invention. Referring to FIGS. 1 and 2, the container 10 has a lid 12 secured by a bayonet lock and a compartment 14 for housing an audio device. The container 10 has a body 16 formed by an outer wall 18, which extends from the base 20 of the container to its top 22. The outer wall 18, base 20 and top 22 define an internal chamber 24 for storing objects or material intended to be inaccessible to small children. The top 22 of the outer wall 18 has an upwardly extending cylindrical neck 26, which has a width smaller than the width of the outer wall 18, such that the intersection of the outer wall 18 and the neck 26 forms a shoulder 28. The rim 30 of the neck 26 defines an opening into an internal chamber 24. The cylindrical neck 26 includes two or more radially spaced slots 27 described in more detail below.

The lid 12 has a top surface 32 defined by a perimeter 34. A cuff 36 extends downwardly from the perimeter 34 and is configured to slide over the neck 26 of the body 16. An opening 38 in the top surface 32 provides access to a compartment 14. A protective screen 40 extends over and covers the opening 38. A gasket 42 is positioned underneath the top surface 32 alongside the cuff 36 and forms a seal between the lid 12 and the rim 30 of the neck 26 when the container 10 is closed.

In this embodiment, the body 16 of the container 10 is cylindrical. Therefore, the outer wall 18, the internal chamber 24 are cylindrical, with the neck 26 having a smaller diameter than the diameter of the outer wall 18. The width of the annular shoulder 28 is defined by the difference in diameter of the outer wall 18 and the neck 26. In addition, the base 20 is circular and the internal chamber 24 is cylindrical.

Figure 3:
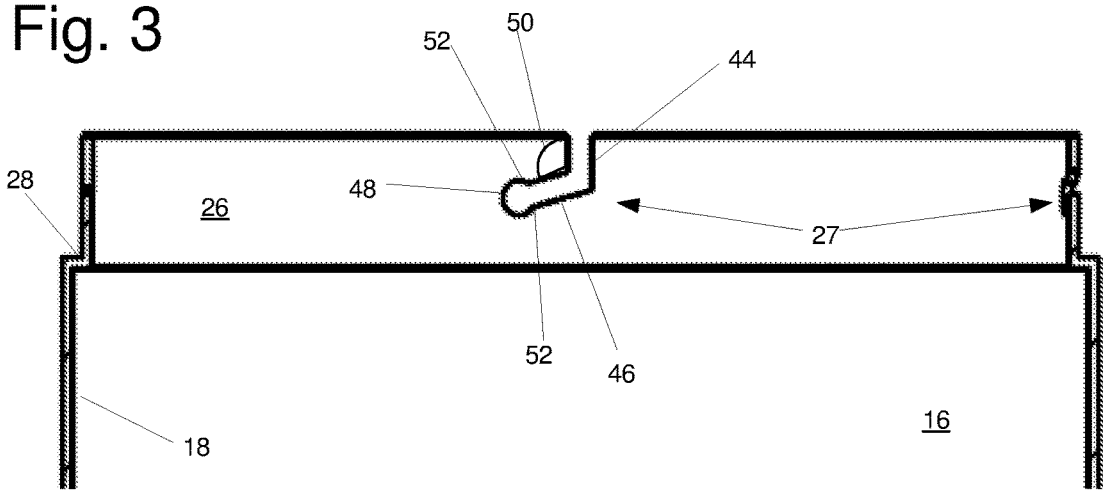
FIG. 3 is a side elevation view of a container in accordance with principles of the invention.

Referring now to FIG. 3, the slots 27 are evenly spaced radially about the neck 26. In this embodiment, four slots 27 are evenly spaced radially 90° apart from each other. Optionally, as few as two slots may be included or additional slots may be used. Preferably, the slots are spaced evenly radially about the neck 26, but other spacing patterns may also be used. Also in this embodiment, the slots 27 extend through the entire thickness of the neck 26. Optionally, the slots 27 may extend only partially through the thickness of the neck 26 and therefore be visible only on the outside of the neck.

The slots are formed from a vertical channel 44, a slanted lateral channel 46 and a circular seat 48. The vertical channel 44 extends downwardly, perpendicular to the rim 30 of the neck 26. The vertical and slanted lateral channels 44 and 46 have equal with and meet at an obtuse angle 50, preferably between 90° and 135°. The diameter of the circular seat 48 is slightly larger than the width of the slanted lateral channel 46, and the slanted lateral channel is aligned with the center of the circular seat such that there are two symmetric opposing protuberances 52 in the slot 27 where the slanted lateral channel 46 intersects the seat 48. That is, a line drawn along the middle of the slanted lateral channel 46 will intersect the center of the circle defining the seat 48. Bayonet locks of the prior art typically are formed from a vertical channel intersecting a perpendicular horizontal channel with either no protrusions or only a single protrusion along the top of the slot. The slot 27 of the present invention includes the two symmetric opposing protuberances 52 to hold a pin within the seat 48 more securely so that little or no upward bias is required to secure the pin in the seat.

Figure 4:
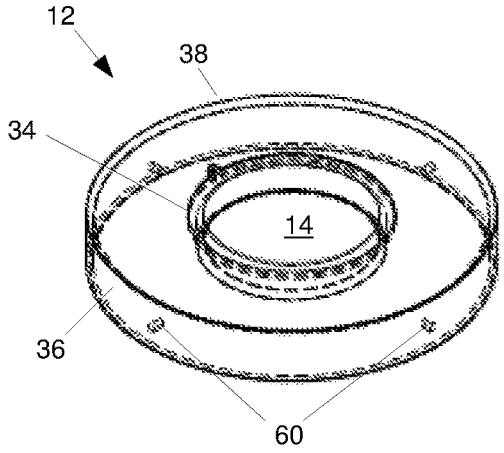
FIG. 4 is a perspective view of a lid for a container in accordance with principles of the invention.
Figure 5:
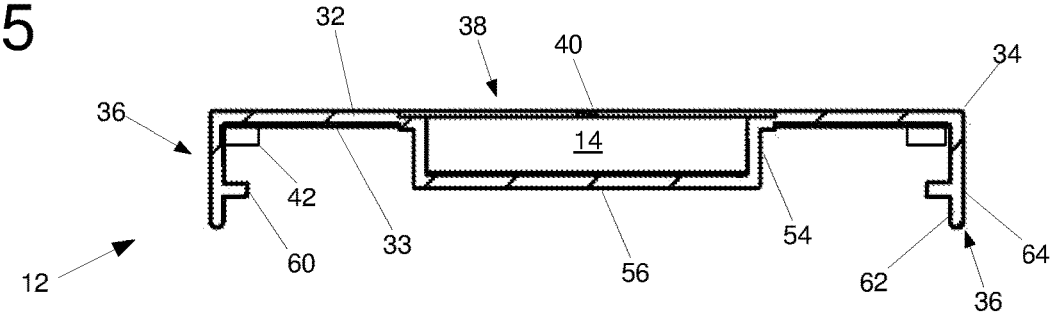
FIG. 5 is a side elevation view of a lid for a container in accordance with the principles of the invention.

Referring to FIGS. 4 and 5, the lid 12 of this embodiment has a circular, planar top surface 32 and a cylindrical cuff 36 extending perpendicularly downward from the circular perimeter 34. Optionally, the top surface 32 may have a hemispherical or other configuration. The compartment 14 of this embodiment is also cylindrical and concentric with the cuff 36. The compartment 14 may optionally have other configurations and may for example be polygonal. The compartment 14 has a circular sidewall 54 extending upward from the perimeter of the circular floor 56 to define the opening 38 in the top surface 32. The compartment 14 houses an audio device, which is not shown in FIGS. 4 and 5. A protective screen 40 extends over and covers the opening 38. The screen 40 is removable and includes several through holes which allows sound emitted by the audio device to pass through the screen 40 and be heard by persons in the vicinity of the lid 12. The screen 40 may be removably attached to the top surface 32 of the lid 12 by a hinge and/or a latch, or other fastening mechanism.

The lid includes a plurality of pins 60 protruding radially inward from the inside wall 62 of the cuff 36. The pins 60 are complementary to the slots 27 in the neck 26. In this embodiment, the pins are cylindrical and have a diameter less than the diameter of the seat 48 but greater than the width of the channels 44 and 46. The pins 60 are semirigid and capable of deforming sufficiently to squeeze them through the channels 44 and 46 as the lid 12 is being attached to the container body 16. When the pins 60 and the seat 48, the symmetric opposing protuberances 52 secure the pins 60 in place and prevent the lid 12 from being removed. Optionally, the pins 60 may be formed from a rigid material and the neck 26 may be formed from a semirigid material capable of being deformed sufficiently to allow the pins 62 travel through the slot 27 and into the seat 48. Optionally, both the pins 60 and the neck 26 may both be formed from a semirigid material to facilitate translation of the pins 60 through the slots 27. The cuff 36 has an outer wall 64 having a diameter equal to the diameter of the outer wall 18 of the body 16. The inner wall 62 is configured to lie flush against the neck 26 when the lid 12 is attached.

The gasket 42 fits underneath the lid 12 on the bottom surface 33 and abutting against the inner wall 62. When the lid 12 is attached to the body 16 and the pins 60 are secured within the seats 48, the gasket 42 forms a seal with the rim 30 of the neck 26. The gasket 42 is an optional feature and not required for the container 10 to operate properly. However, the gasket may be desirable to form a tight seal between the internal chamber 24 and the outside of the container 10. It may also be desirable to utilize an elastomeric gasket 42 that creates a bias pushing the lid 12 away from the body 16 to prevent rattling or jiggling of the lid and/or two assist in securing the lid 12 and a secured closed configuration. If an elastomeric gasket 42 is used to generate a bias pushing the lid 12, away from the body 16 the pins 60 may be modified to have a diameter of approximately equal to the width of the vertical and slanted lateral channels 44 and 46. Optionally, the gasket 42 may be permanently attached to the inside of the lid 12. The gasket 42 may optionally also cover a larger portion of the bottom surface 33, and may extend to cover the entire region between the inner wall 62 and the sidewall 54 of the compartment 14.

Figure 6:
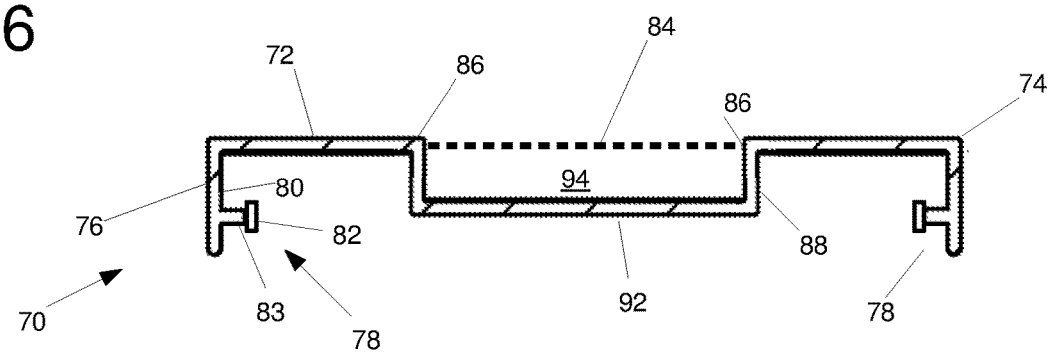
FIG. 6 is a side elevation view of an alternative embodiment of a lid for a container in accordance with the principles of the invention.

FIG. 6 shows an alternative embodiment of a lid 70 in accordance with the principles of the invention. The lid 70 has a circular, planar top surface 72 defined by a perimeter 74 and a cuff 76 extending downward perpendicular to the top surface of the lid. A plurality of radially spaced pins 78 extend inward from the inner wall 80 of the cuff 76, and are complementary slots such as those described above. Each of these pins 78 has a distal flange 82 extending perpendicular to the pen's stems 83. The distal flange is 82 may be used to improve the seal between internal chamber and the exterior of a container having slots in the neck which extend all the way through the thickness of the neck. The lid 70 also includes an opening 84 in the top surface 72 which is defined by a continuous edge 86. A compartment sidewall 88 extends downward from the edge 86 to the planar floor 92, thereby defining a compartment 94. In this embodiment, a protective screen does not cover the top of the compartment. In addition, there is no gasket underneath the lid.

Figure 7:
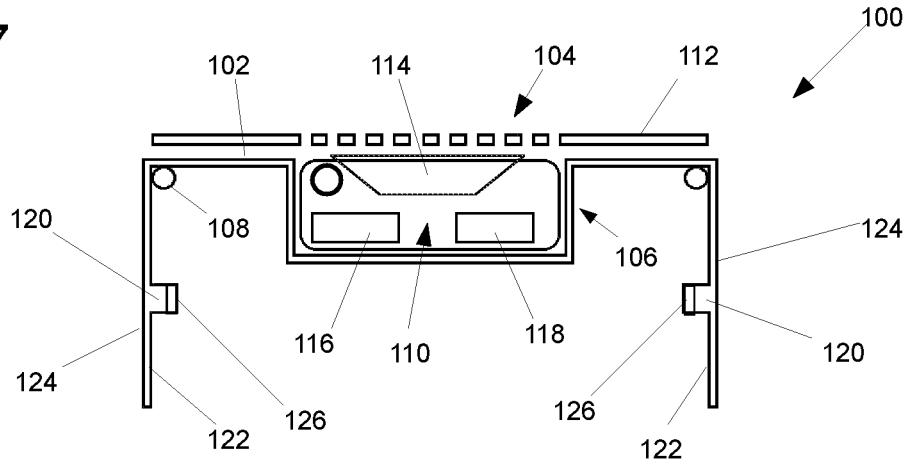
FIG. 7 is a side elevation view of another alternative embodiment of a lid for a container in accordance with the principles of the invention.

FIG. 7 shows another alternative embodiment of a lid 100 in accordance with principles of the invention. Lid 100 has a planar, circular top surface 102 having an opening 104 leading into a compartment 106. A gasket 108 is provided for the reasons provided above. An audio device 110 is housed within the compartment 106 and held in place by a removable protective screen 112 extending over the entire top surface 102 of the lid 100. The audio device includes a speaker 114, a microcontroller 116 and a wireless connection module 118.

Pins 120 extends inwardly from the inner wall 122 of the cuff 124. The distal end of each pin 120 has an electrical contact pad 126. The contact pads 126 are all in electrical communication with the audio device 120. The audio device 120 is configured to detect when a circuit is closed between two of the contact pads 126. In other words, the audio device 120 detects whether current is capable of flowing directly from one of contact pads 126 to any of the other contact pads.

Figure 8:
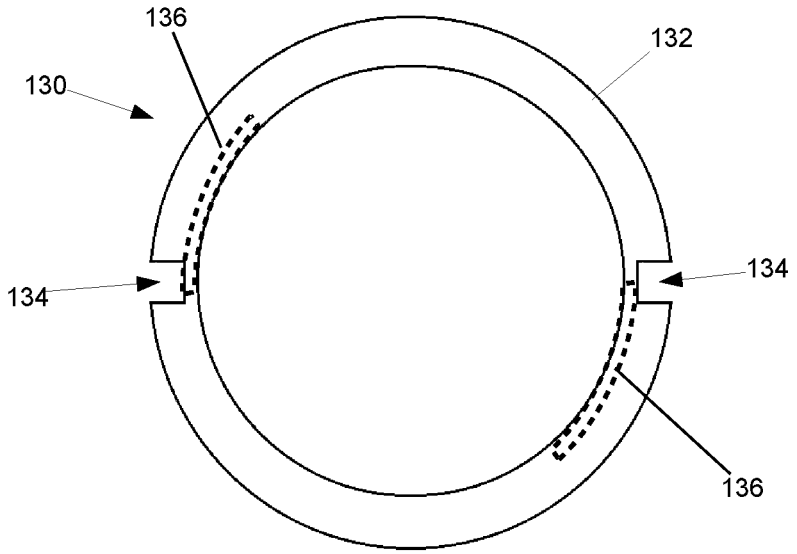
FIG. 8 is a top plan view of a neck of a container in accordance with the principles of the invention.

FIG. 8 shows an alternative embodiment of a neck 130 of a container in accordance with principles of the invention. The neck 130 is defined by a circular wall 132 which has two or more slots 134 for engaging complementary pins on a lid. Slots 134 do not extend entirely through the width of the neck 130. An electrical conductor 136, such as a wire or a thin strip of magnetic material is located within two or more of the slots 134. When the lid 100 shown in FIG. 7 is secured onto a container having a neck 130, the contact pads 126 come into contact with the electrical conductor 136, thereby creating a closed circuit. When the audio device 120 detects a closed circuit between two or more of the contact pads 126 abutting against the electrical conductor 136, it interprets the signal to mean that the container is completely closed. When no closed-circuit exists between contact pads 126, the audio device 120 interprets the signal to mean that the container has been opened. Whenever the containers opened, the audio device may be programmed to emit an alarm through the speaker 114. Similarly, when the audio device 120 may send an alert signal through its wireless connection module 118 to a remote electronic device such as a laptop, tablet or cell phone. This allows a person to be alerted whenever someone opens the container.

The audio device 120 may also be programmed to play music stored on the device or to stream music through a wireless connection. The audio device 120 may also optionally include a microphone 140 so that it can record and playback alarms, signals, words spoken into the microphone. The container in accordance with principles of the invention may also be wirelessly connected as part of an internet of things.

The exemplary embodiments herein show a cylindrical container. Those skilled in the art will appreciate that the container in accordance with principles of the invention may have many possible different configurations. The outer wall of the neck of the container and the inner wall of the lid's cuff, however, must be cylindrical.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated. Those skilled in the art will appreciate that the conception, upon which this disclosure is based, may readily be utilized as a basis for the designing of other structures, methods and systems for practicing the present invention. It is important, therefore, that the claims be regarded as including such equivalent constructions insofar as they do not depart from the spirit and scope of the present invention.

The invention claimed is:

1. A child resistant container having an audio device comprising:

a container having a body defined by an outer wall defining a diameter of the container, wherein the container extends between a base and a top;

a cylindrical neck extending upward from the top of the container, having a diameter less than a diameter of the of the container;

two or more radially spaced slots each having a seat and a channel extending from a rim of the neck to each seat, wherein each seat has a diameter larger than a width of the slot each channel such that the intersection of each seat each channel form opposing protuberances;

an electrical conductor located within each radially spaced slot;

a lid having a top surface defined by a perimeter, wherein the top surface includes a plurality of openings;

a cuff extending downward from the perimeter of the lid;

two or more radially spaced pins protruding inwardly from a cylindrical inner wall of the cuff and complimentary to the two or more radially spaced slots of the neck, wherein the two or more pins each include an electrical contact pad at a distal end;

a compartment in the lid extending downwardly from an opening in the top surface of the lid; and, a sound emitting device housed in the compartment of the lid;

wherein the two or more radially spaced pins and the two or more complementary radially spaced slots form a bayonet lock mechanism for removably securing the cap to the top of the container;

wherein when the cap is secured to the container, the electrical conductor forms a closed circuit between the electrical contact pads; and wherein the sound emitting device emits an alarm through the plurality of openings in the top surface of the lid when the circuit is broken.

2. The child resistant container having an audio device of claim 1 further comprising a microcontroller and a wireless connection module located in the compartment of the lid and the microcontroller sends an alert signal through the wireless connection when the circuit is broken.

3. The child resistant container having an audio device of claim 2 wherein the microcontroller is configured to wirelessly stream music through the sound emitting device from another device wirelessly connected to the microcontroller.

4. The child resistant container having an audio device of claim 3 further comprising a microphone and wherein the alarm emitted by the sound emitting device comprises a recording made by the microphone.

* * * * *